US007413278B2

(12) United States Patent
Kusakari

(10) Patent No.: US 7,413,278 B2
(45) Date of Patent: Aug. 19, 2008

(54) IMAGE FORMING APPARATUS AND EJECTION DETERMINING METHOD

(75) Inventor: Tsutomu Kusakari, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 367 days.

(21) Appl. No.: 11/029,400

(22) Filed: Jan. 6, 2005

(65) Prior Publication Data

US 2005/0146550 A1 Jul. 7, 2005

(30) Foreign Application Priority Data

Jan. 7, 2004 (JP) ..... 2004-001776

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,530,462 | A | 6/1996 | Takahashi et al. | |
| 7,163,275 | B2 * | 1/2007 | Yeh et al. | 347/19 |
| 2004/0196319 | A1 | 10/2004 | Aruga | |

FOREIGN PATENT DOCUMENTS

| | | | |
|---|---|---|---|
| JP | 63260448 | A | 10/1988 |
| JP | 02-194967 | A | 1/1990 |
| JP | 02022066 | A | 1/1990 |
| JP | 2001310478 | A | 11/2001 |
| JP | 2002-292843 | A | 10/2002 |
| JP | 2002292843 | A * | 10/2002 |
| JP | 2003-191453 | A | 7/2003 |
| JP | 2003191453 | A * | 7/2003 |
| JP | 2004-216339 | A | 8/2004 |
| JP | 2004216339 | A * | 8/2004 |

OTHER PUBLICATIONS

Japanese Document Translation of Ariga, Publication No. 2003191453 A.*

* cited by examiner

*Primary Examiner*—Stephen D. Meier
*Assistant Examiner*—Rene Garcia, Jr.
(74) *Attorney, Agent, or Firm*—Birch, Stewart, Kolasch & Birch, LLP

(57) ABSTRACT

An image forming apparatus includes a light-emitting device which generates determination light which intersects with flight paths of ink droplets ejected from ejection head nozzles; a light receiving device which receives the determination light and outputs a determination signal corresponding to quantity of the determination light received; a drive control device which controls stagger of ejection timing of a nozzle subject to an ejection determination in accordance with ejection timings of other nozzles by controlling the ejection drive device based on image data during a recording ejection operation for forming an image on the recording medium; and an ejection state judging device which judges ejection state of the ink droplets from the nozzle subject to the ejection determination, based on the determination signal obtained from the light receiving device at a determination timing corresponding to the ejection timing of the nozzle subject to the ejection determination.

6 Claims, 13 Drawing Sheets

IMAGE FORMING APPARATUS AND EJECTION DETERMINING METHOD

BACKGROUND OF THE INVENTION

1. Field of the Invention

The present invention relates to an image forming apparatus and an ejection determining method, and more specifically to an image forming apparatus and ejection determining method suitable for determining nozzles with ejection defects in an inkjet head having a plurality of droplet ejection holes (nozzles).

2. Description of the Related Art

An inkjet type image forming apparatus forms images on a recording medium by ejecting ink droplets from nozzles while moving a print head (recording head) in which a plurality of nozzles are arranged and a recording medium relatively with respect to each other. This kind of apparatus may cause the ejection defects such as the obstruction of ink ejection from the nozzles, the defective amount of ink ejected (the dot size deposited on the recording medium), and the defective position to deposit ink, for some reasons according to the increase of the ink viscosity of ink in the head, the infiltration of air bubbles into the ink, and the like.

For this reason, a method in which ejection failures are detected on the basis of the transmissivity of the light by irradiating light, such as laser light, onto droplets ejected from a print head is known in the prior art (referred as to Japanese Patent Application Publication No. 2003-191453).

Japanese Patent Application Publication No. 2003-191453 suggests a method in which the ejection timing of ink in a nozzle group under observation is staggered with respect to other nozzle groups by a time period shorter than the recording ejection cycle according to an inkjet printer comprising a light source and a light receiver for determining ejections.

However, the determination method suggested in Japanese Patent Application Publication No. 2003-191453 is the method to achieve high-speed determination, and the method to control the ejection in units of nozzle groups. Therefore, it is impossible to control the ejection with respect to individual nozzles. Furthermore, in the method disclosed in Japanese Patent Application Publication No. 2003-191453, since the sequence and number of the nozzles to be inspected are limited, it is not possible to carry out inspection in any desired sequence. Even if the number of nozzles to be inspected is limited to a small number, an inspection time equivalent to the time required to inspect all of the nozzles is still needed.

In an embodiment of Japanese Patent Application Publication No. 2003-191453, inspection is carried out in sequence from one end of the nozzle row, and the ejection sequence during determination is predetermined. Therefore, there is little freedom in the ejection sequence and ejection determination cannot be carried out during a printing operation.

SUMMARY OF THE INVENTION

The present invention has been contrived in view of such circumstances, and an object thereof is to provide an image forming apparatus and an ejection determining method whereby defects relating to ejection or ejection failure can be determined by determining droplets in flight during a printing operation, and whereby ejection determination can be carried out in nozzle units.

In order to attain the aforementioned object, the present invention is directed to an image forming apparatus, comprising: an ejection head which includes a plurality of nozzles to eject ink droplets; an ejection driving device which drives ejection to eject the ink droplets from the nozzles of the ejection head onto a recording medium; a conveyance device which moves the ejection head and the recording medium relatively to each other by conveying at least one of the ejection head and the recording medium; a light-emitting device which generates determination light which intersects with flight paths of the ink droplets ejected from the nozzles; a light receiving device which receives the determination light having passed through the flight paths and outputs a determination signal corresponding to quantity of the determination light received; a drive control device which controls stagger of ejection timing of a nozzle subject to an ejection determination in accordance with ejection timings of other nozzles by controlling the ejection drive device on the basis of image data during a recording ejection operation for forming an image on the recording medium; and an ejection state judging device which judges ejection state of the ink droplets from the nozzle subject to the ejection determination, on the basis of the determination signal which is obtained from the light receiving device at a determination timing corresponding to the ejection timing of the nozzle subject to the ejection determination.

The image forming apparatus according to the present invention forms an image on a recording medium by relatively moving an ejection head and a recording medium, while ejecting ink droplets from nozzles of the ejection head on the basis of data for the image that is to be printed. During a operation for recording an actual image, a time difference is created in the timing at which the ink droplets pass through the determination light, by implementing ejection control in such a manner that the ejection timing of a particular nozzle (a nozzle selected for ejection determination) is staggered with respect to the ejection timing of the other nozzles (nozzles that are not subject to ejection determination). It is possible to judge whether or not an ink droplet has been ejected normally from that nozzle, by focusing on the change in the determination signal obtained from the light receiving device at the determination timing that corresponds to the ejection timing for the nozzle subject to ejection determination. In addition, any of the plurality of nozzles can be selected as a nozzle to be subject to ejection determination, and it is possible to inspect whether or not ejection has occurred in units of individual nozzles by changing the nozzles set for ejection determination appropriately.

According to the present invention, since ejection determination can be performed with respect to individual nozzles during a recording operation for an actual image where a print output is actually required, print productivity can be raised. Moreover, since special ejection operations for ejection determination, such as test printing, are not required, it is possible to prevent ink and recording media from being consumed wastefully. Still more, since the ejection timing for a nozzle subject to ejection determination is not same to the standard (normal) timing, the landing position of the ink from the nozzle subject to ejection determination is displaced slightly from the original target landing position during recording. However, displacement of a small number of droplets in high-density printing at photographic quality has hardly any effect on image quality (i.e., it does not lead to the defection of image).

In the image forming apparatus relating to the present invention, desirably, the determination optical system is composed in such manners that the optical axis of the determination light is parallel or substantially parallel to the direction of the nozzle rows in the ejection head, and the determination beam intersects with the ink flight paths from all of the nozzles in the same nozzle row. Furthermore, it is desirable to stagger the ejection timing of the nozzle to be subject to ejection determination selected from a particular nozzle row with respect to the ejection timing of the group of other nozzles.

The mode of the ejection head in the image forming apparatus according to the present invention is not limited in particular. For example, it is possible to use a full line recording head having a nozzle row in which a plurality of nozzles that eject ink are arranged through a length corresponding to the full width of the recording paper in a direction substantially orthogonal to the direction of conveyance of the recording medium. Furthermore, the present invention may also be applied to a shuttle type recording head in which a recording head carries out printing while moving reciprocally in a direction substantially orthogonal to the direction of conveyance of the recording medium.

A "full-line recording head (discharge head)" is normally disposed along the direction perpendicular to the relative delivering direction of the printing medium (the conveyance direction), but also possible is an aspect in which the recording head is disposed along the diagonal direction given a predetermined angle with respect to the direction perpendicular to the conveyance direction. The arrangement of the image-recording elements in the recording head is not limited to a single row array in the form of a line, but a matrix array (two-dimensional array) composed of a plurality of rows is also possible. Furthermore, also possible is an aspect in which a plurality of short-length recording head units having a row of image-recording elements that do not have lengths that correspond to the entire width of the printing medium are combined and the image-recording element rows are configured so as to correspond to the entire width of the printing medium, with these units acting as a whole.

The "printing medium" is a medium (an object that may be referred to as an image formation medium, recording medium, recorded medium, image receiving medium, or the like) that receives the printing of the recording head, and includes continuous paper, cut paper, seal paper, resin sheets such as sheets used for overhead projectors (OHP), film, cloth, and various other media without regard to materials or shapes.

The term "conveying device" includes an aspect in which the printing medium is conveyed with respect to a stopped (fixed) recording head, an aspect in which the recording head is moved with respect to a stopped printing medium, or an aspect in which both the recording head and the printing medium are moved.

Preferably, the drive control device makes the ejection timing of the nozzle subject to the ejection determination different than the ejection timings of the other nozzles, within range of a recording ejection cycle during a normal recording ejection operation in which no ejection determination is carried out.

By setting the amount of time by which the ejection timing of the nozzle subject to ejection determination is staggered to a time within the range of the recording ejection cycle when determination is not being performed, it is possible to determine ejection without causing the print speed to decline. Furthermore, the displacement of the landing position will be less than the interval between pixels.

Preferably, the drive control device sets a recording ejection cycle of the other nozzles at a value obtained by multiplying an recording ejection cycle T during a normal recording ejection operation in which no ejection determination is carried out, by a positive number n, while setting a conveyance speed of the conveyance device at a value obtained by multiplying a conveyance speed V during the normal recording ejection operation by $$\frac{1}{n}).$$

in synchronization with the recording ejection cycle obtained, so as to control the nozzle subject to the ejection determination for ejecting between respective ejection timings of the other nozzles on the basis of the recording ejection cycle obtained.

According to the present invention, during a normal recording operation where ejection determination is not performed, ejection is driven at a recording ejection cycle of T. During the ejection determination, while the recording ejection cycle is changed to n×T, the conveyance speed is changed to $$\frac{1}{n}.$$

Then, the nozzle subject to ejection determination is driven to perform ejection between the ejection operations of the other nozzles, which are driven at those recording ejection cycle. In the case of taking n to be a positive number of 2 or more, it is possible to carry out ejection determination n−1 times between the ejection operations of the other nozzles.

The present invention also provides the image forming apparatus further comprising: a history information storage device which stores history information including at least one of history of the ejection determination and history of the ejection; and a nozzle selecting device which selects the nozzle to subject to the ejection determination on the basis of the history information.

According to the present invention, it is possible to set nozzles judged to have an ejection defect in a previous ejection determination operation, or nozzles which have not performed ejection for a prescribed period of time or more, as nozzles to be subject to ejection determination. In this way, by using the history information to infer (predict) nozzles having a high possibility of ejection defect and inspecting these nozzles preferentially, it is possible to avoid unnecessary determination operations, and hence determination efficiency can be improved.

In order to attain the aforementioned object, the present invention is directed to a method for achieving the aforementioned objects. More specifically, the ejection determining method according to the present invention is an ejection determining method of an image forming apparatus which forms an image on a recording medium by ejecting ink droplets from nozzles of an ejection head formed with a plurality of nozzles which eject the ink droplets, while relatively moving the ejection head and the recording medium by conveying at least one of the ejection head and the recording head, the ejection determining method comprising the steps of: providing a light emitting device which emits determination light intersecting with flight paths of the ink droplets ejected from the nozzle, and a light receiving device which receives the determination light having passed through the flight paths and obtains a determination signal in accordance with quantity of the determination light received; controlling ejection driving of the nozzles on the basis of image data, and stagger of an ejection timing of a nozzle subject to an ejection determination in accordance with ejection timings of the other nozzles during a recording ejection operation for forming the image on the recording medium; and judging ejection state of the ink droplets from the nozzle subject to the ejection determination on the basis of the determination signal obtained from the light receiving device at a determination timing corresponding to the controlled the ejection timing of the nozzle subject to the ejection determination.

According to the present invention, by providing the image forming apparatus with a light-emitting device and a light-receiving device for optically determining droplets ejected from nozzles of an ejection head, the image forming apparatus has a composition in which droplets in flight are determined during a recording operation for an actual image based on image data. Then, an ejection is determined by staggering the ejection timing for a particular nozzle that is to be subject to ejection determination with respect to the ejection timing for the other nozzles. Therefore, while productivity can be increased, it is possible to judge whether or not ejection has occurred with respect to an individual nozzle. Furthermore, since special ejection operations for determination purposes, such as test printing, are not required, it is possible to prevent ink or recording media from consuming wastefully.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
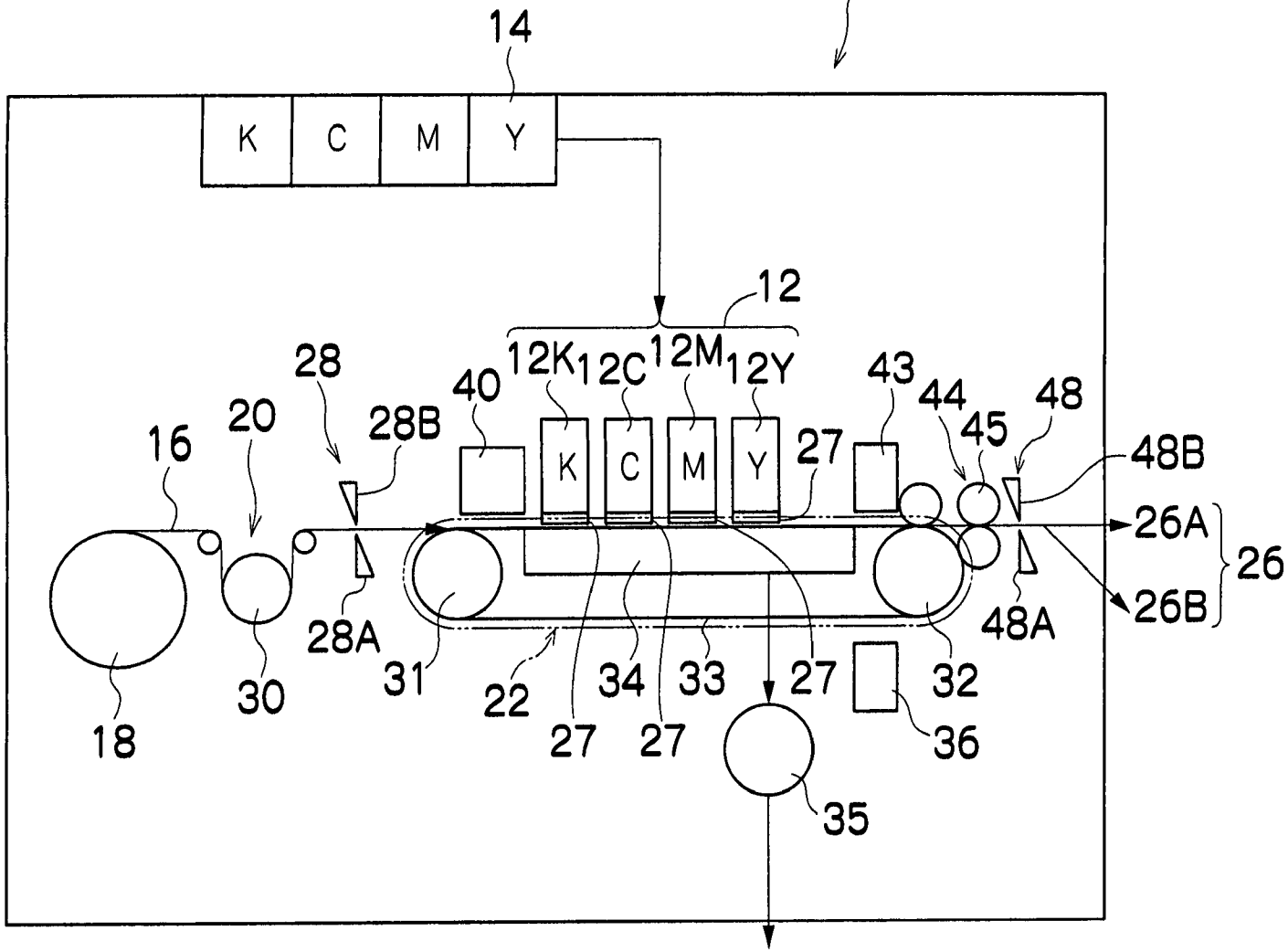
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 (corresponding to the recording medium); a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; and a paper output unit 26 for outputting image-printed recording paper (printed matter) to the exterior. Each of the print heads 12K, 12C, 12M, and 12Y is provided with an ejection determination device 27, which optically detects ink-droplets ejected from the nozzles and being flying.

The ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22 (corresponding to the conveyance device). The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
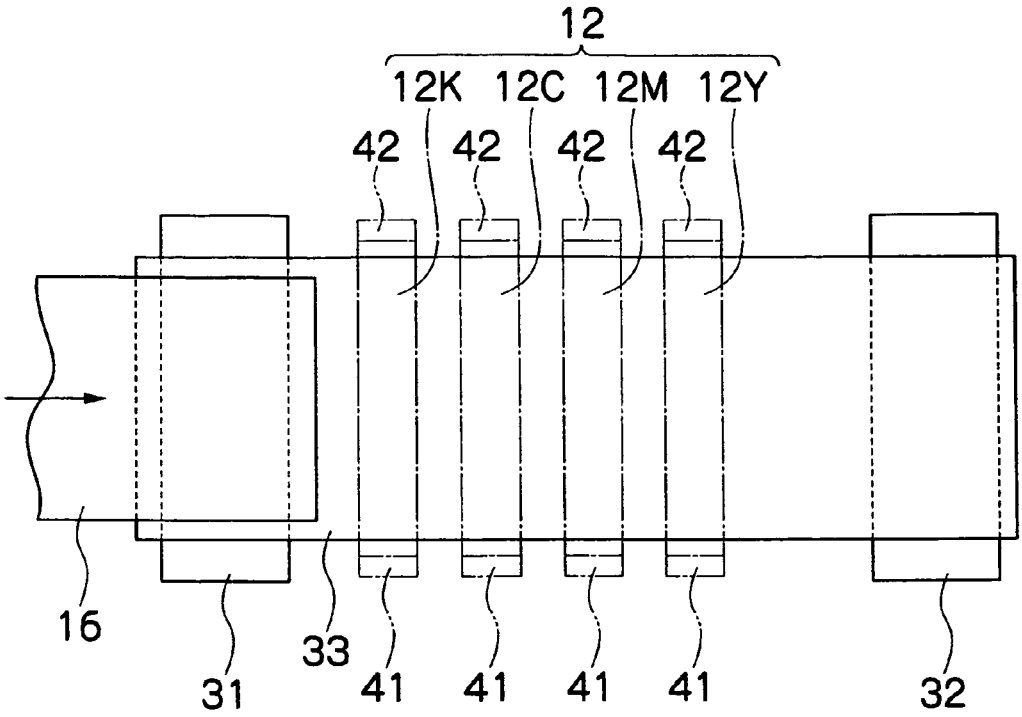
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those. Light and/or dark inks, and special color inks can be added as required. For example, a configuration is possible in which print heads for ejecting light-colored inks such as light cyan and light magenta are added. Furthermore, there is no particular restriction on the order in which the heads of respective colors are arranged.

A light source unit 41 and a light receiving unit 42, constituting an ejection inspection device 27 for evaluating droplets in flight, are disposed respectively in positions opposite to the both ends of the longitudinal direction of the print heads 12K, 12C, 12M, 12Y (see FIG. 2).

A light-emitting element, such as a laser diode (LD) or light-emitting diode (LED), is suitable for using as the light source units 41. When each of light source units 41 irradiates light, the irradiated light arrives at the corresponding light receiving unit 42 through the space where the droplets fly out from the print unit 12. Each of the light receiving units 42 is constituted by a photosensor which outputs an electrical signal in accordance with the quantity of light received. When the amount of light received at the light receiving units 42 varies depending on whether or not ink droplets are present, the output signal (determination signal) from the photosensor varies. Therefore, depending on the determination output signal obtained from the light receiving unit 42, it is possible to judge whether or not there are ink droplets in flight (i.e., to judge whether or not the nozzles are ejecting). The details of this ejection determining method are described hereafter.

As shown in FIG. 1, the post-drying unit 43 is disposed following the print unit 12. The post-drying unit 43 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 43. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Structure of the Print Heads

Next, the structure of the print heads is described. The print heads 12K, 12C, 12M and 12Y provided for the respective ink colors have the same structure, and a reference numeral 50 is hereinafter designated to any of the print heads 12K, 12C, 12M and 12Y.

Figure 3A:
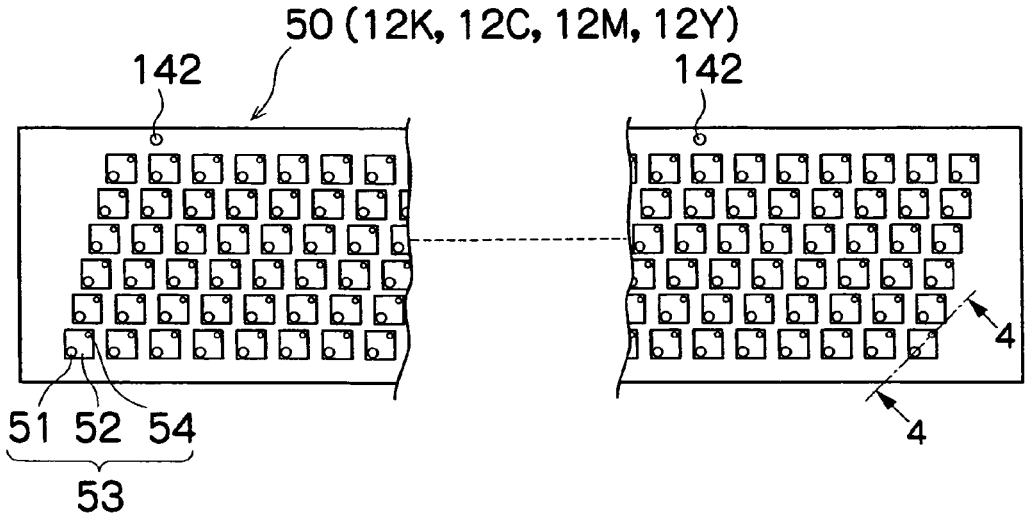
FIG. 3A is a perspective plan view showing an example of a configuration of a print head.
Figure 3B:
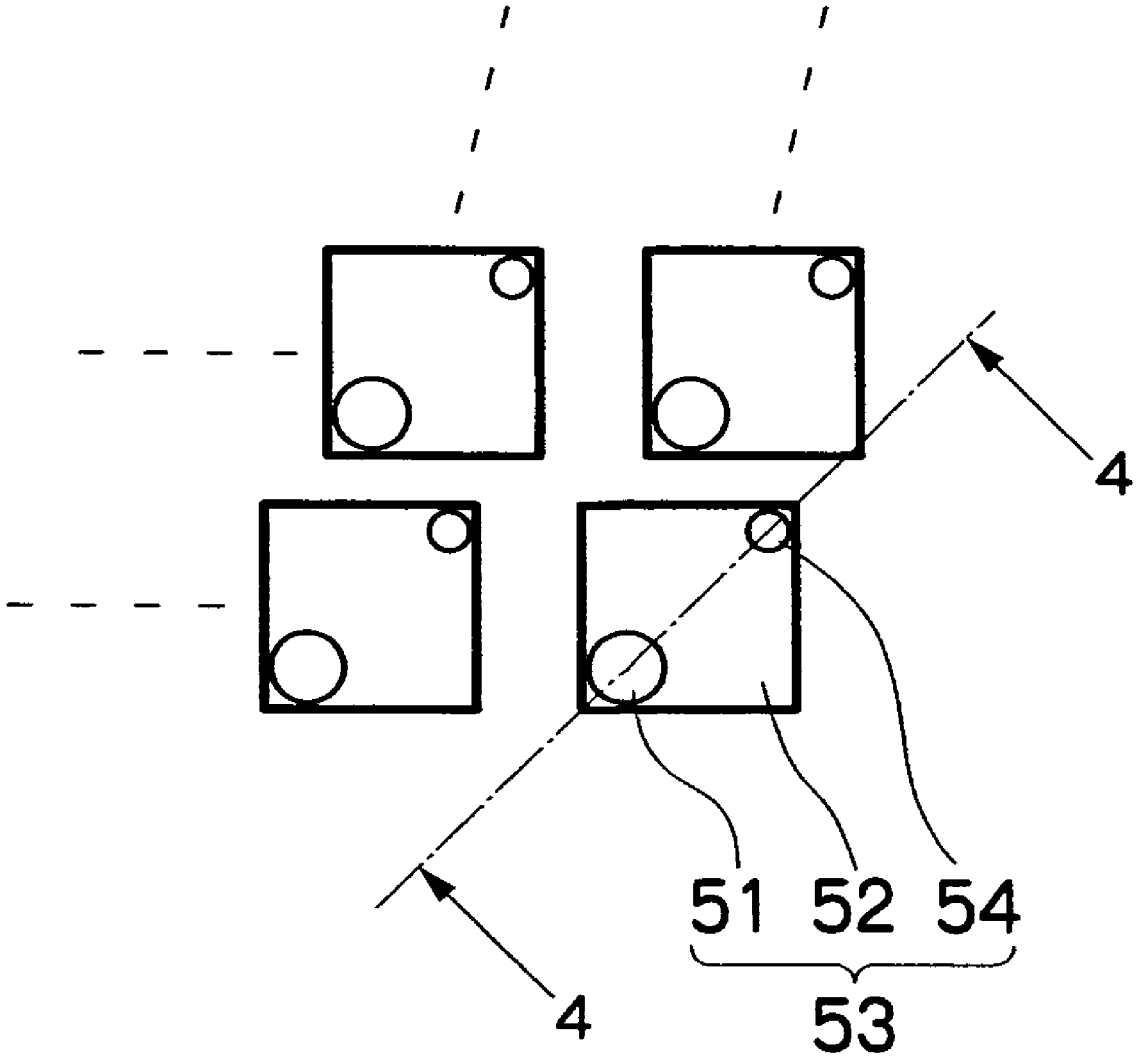
FIG. 3B is a partial enlarged view of FIG. 3A.
Figure 3C:
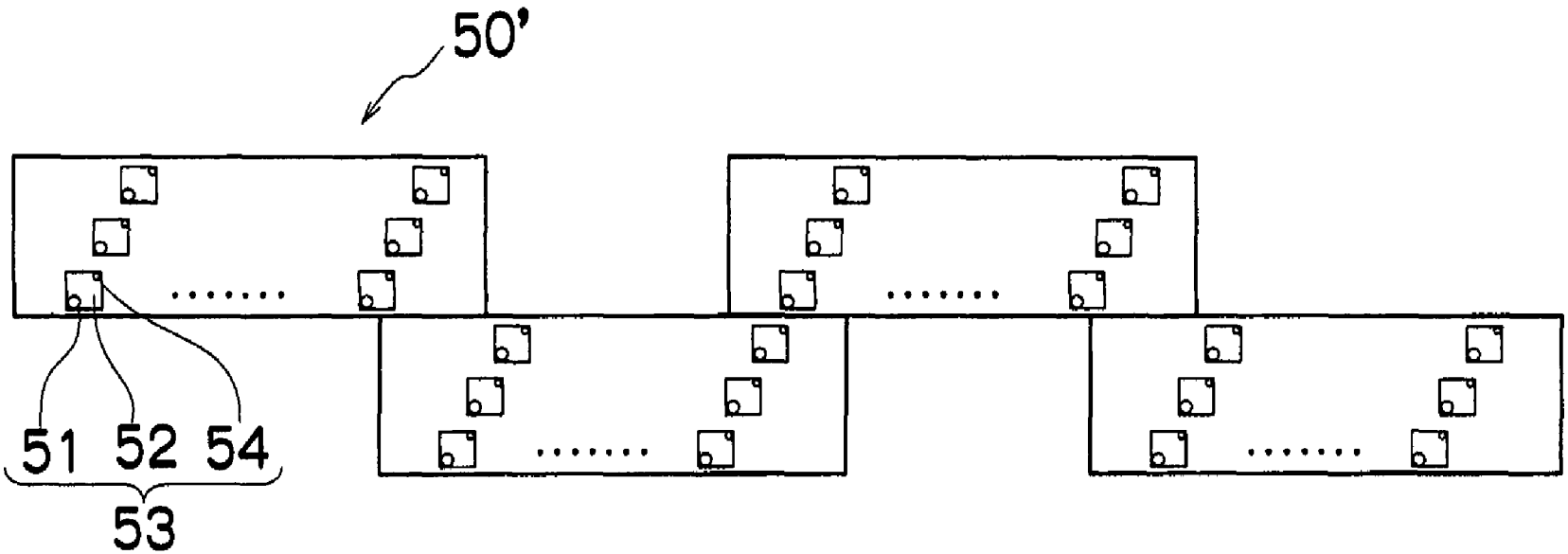
FIG. 3C is a perspective plan view showing another example of the configuration of the print head.
Figure 4:
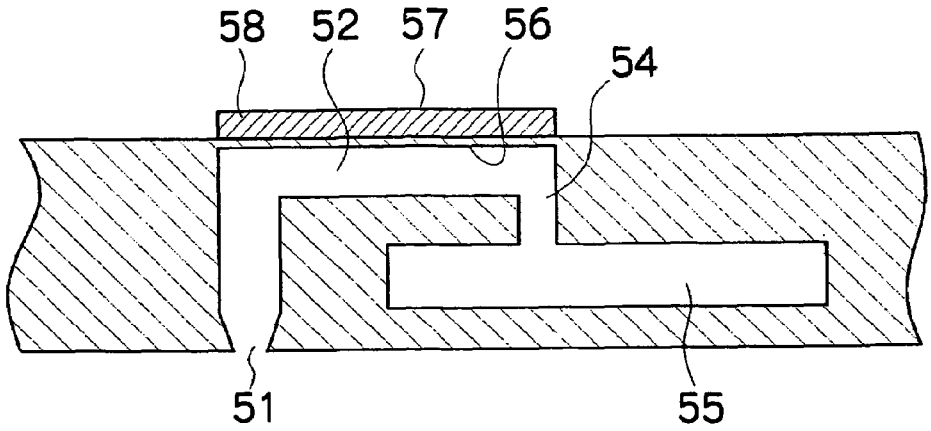
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of a droplet ejection element (i.e., an ink chamber unit corresponding to one of the nozzles 51).

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink ejection nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

As shown in FIGS. 3A to 3C, the planar shape of the pressure chamber 52 provided for each nozzle 51 is substantially a square, and an outlet to the nozzle 51 and an inlet for supplied ink (supply port) 54 are disposed in both corners on a diagonal line of the square. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

As shown in FIG. 4, each pressure chamber 52 is connected to a common channel 55 through the supply port 54. The common channel 55 is connected to an ink tank 60 (not shown in FIG. 4, but shown in FIG. 7), which is a base tank that supplies ink, and the ink supplied from the ink tank 60 is delivered through the common flow channel 55 to the pressure chambers 52.

An actuator 58 provided with an individual electrode 57 is bonded to a pressure plate (diaphragm) 56, which forms a part (the upper face in FIG. 4) of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 5:
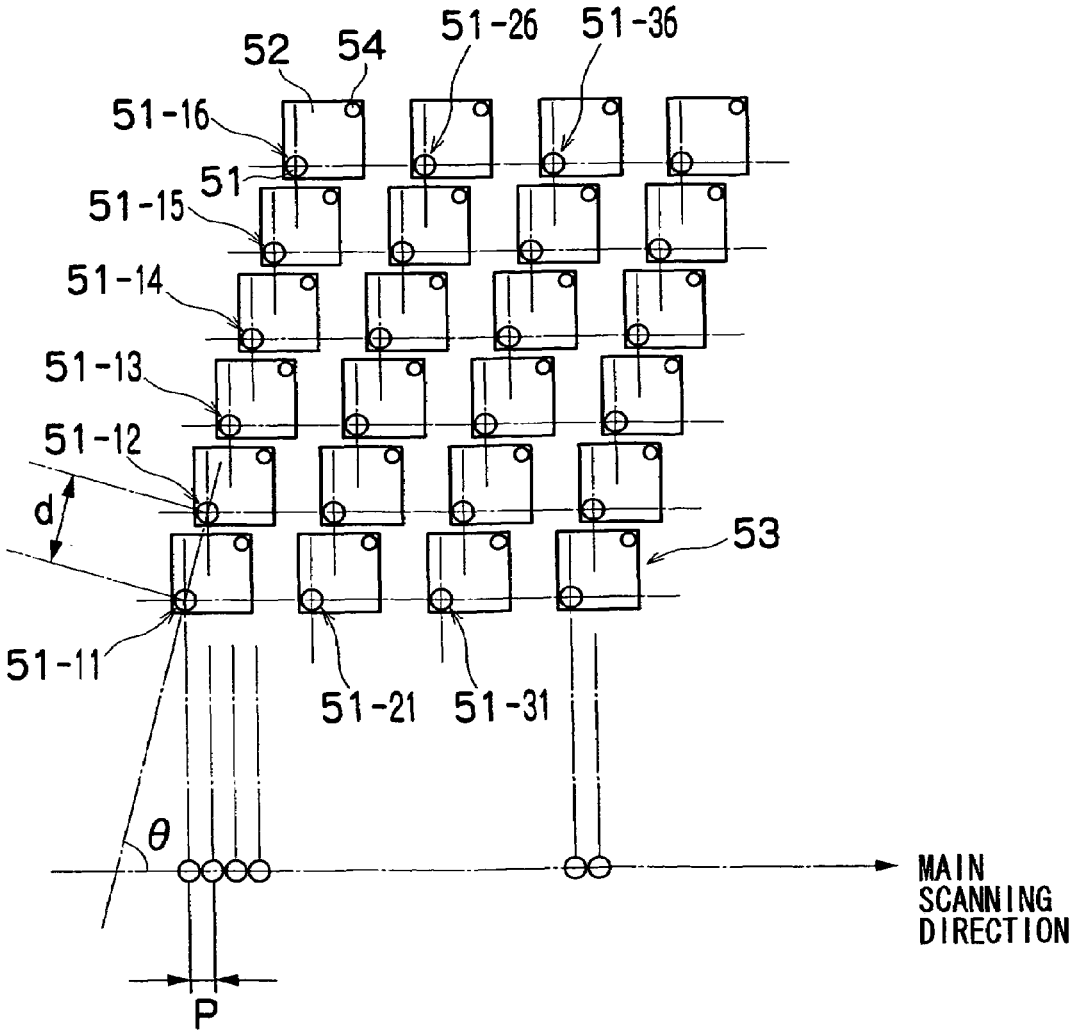
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the image recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording papers 16A and 16B by sequentially driving the nozzles 51-11, 51-12, . . . , 51-16 in accordance with the conveyance velocity of the recording papers 16A and 16B.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Therefore, "the main scanning direction" is the direction of one line (or the longitudinal direction of a band-shaped region) recorded by means of the aforementioned main scanning operation, and "the sub-scanning direction" is the direction in which the aforementioned sub-scanning operation. In other words, in the present embodiment, the direction of conveyance of the recording paper 16 is the sub-scanning direction and the direction orthogonal to this direction is the main scanning direction.

Figure 6:
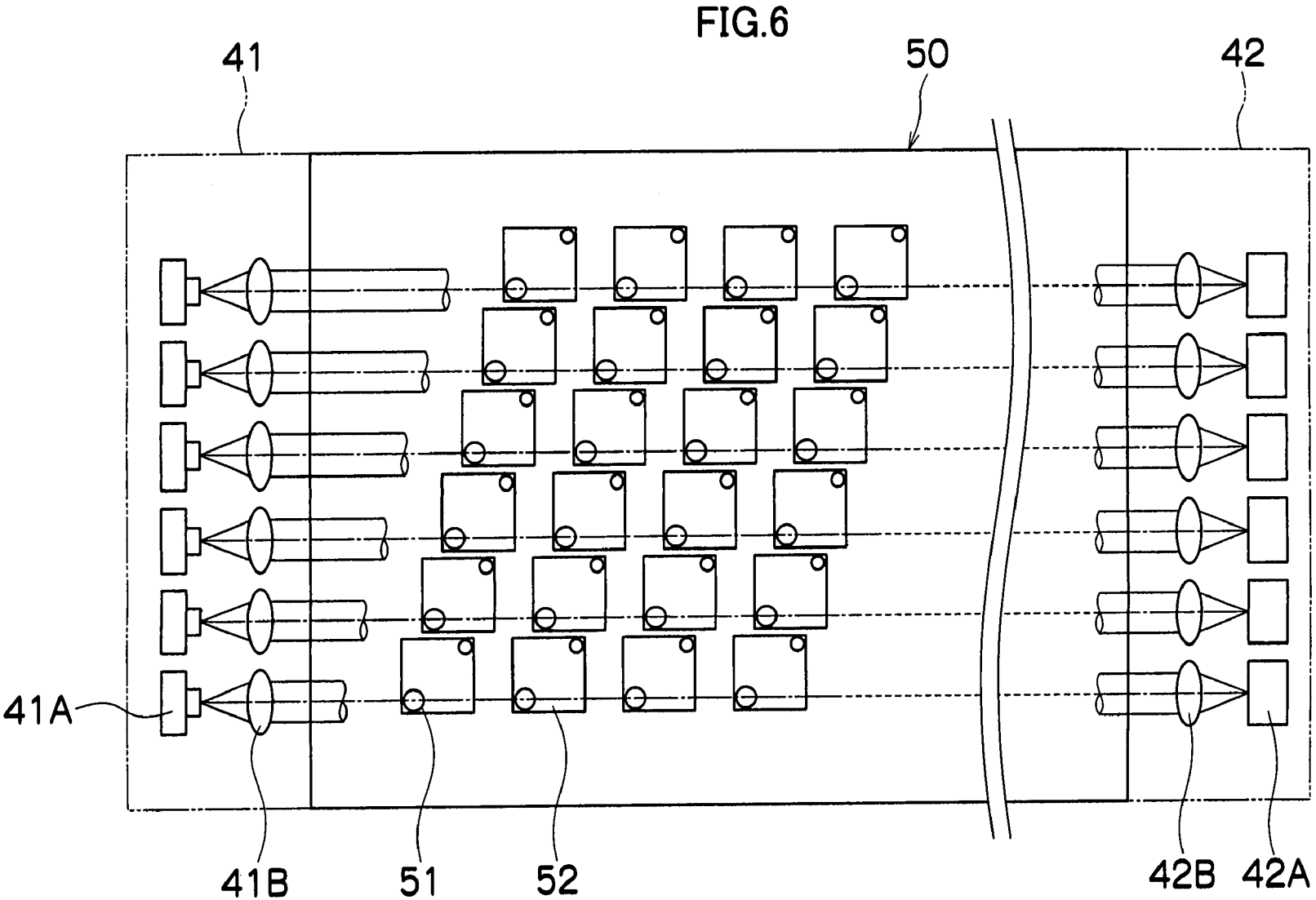
FIG. 6 is a schematic drawing showing a configuration of an ejection determining optical system in the inkjet recording apparatus.

As shown in FIG. 6, the light source units 41, disposed at one end of the longitudinal direction of the print head 50, comprise a light-emitting element 41A and a lens 41B, provided for each row of nozzles 51 arranged in the longitudinal direction of the print head 50. A plurality of light-emitting elements 41A are arranged following the shorter dimension of the head.

Similarly, the light receiving units 42, disposed at the other end of the longitudinal direction of the print head 50, comprise a photosensor 42A and a lens 42B provided for each nozzle row. A plurality of photosensors 42A are arranged following the shorter dimension of the head.

The light emitted from the light receiving element 41A is formed to a prescribed beam diameter by passing through a lens 41B, and is irradiated in parallel (or substantially in parallel) to the corresponding nozzle row while intersecting with the flight paths of the ink from all of the nozzles in that row. The detection beam passes through a lens 42B of the light receiving unit 42 and is guided to the photosensor 42A.

In the case of a high-density nozzle which achieves images of 2400 dpi, for example, the dimension of one edge of a pressure chamber 52 is approximately 500 μm. The interval between the positions of the nozzles 51 in the direction of the shorter dimension of the print head 50(the sub-scanning direction), i.e. the interval between nozzle rows is approximately 500-1000 μm. If a determination optical system having a beam diameter of approximately 200-300 μm is designed in order to correspond to an arrangement structure of this kind, then a plurality of light-emitting elements 41A and photosensors 42A can be arranged without interference in the shorter direction of the print head 50.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for ejecting ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 7:
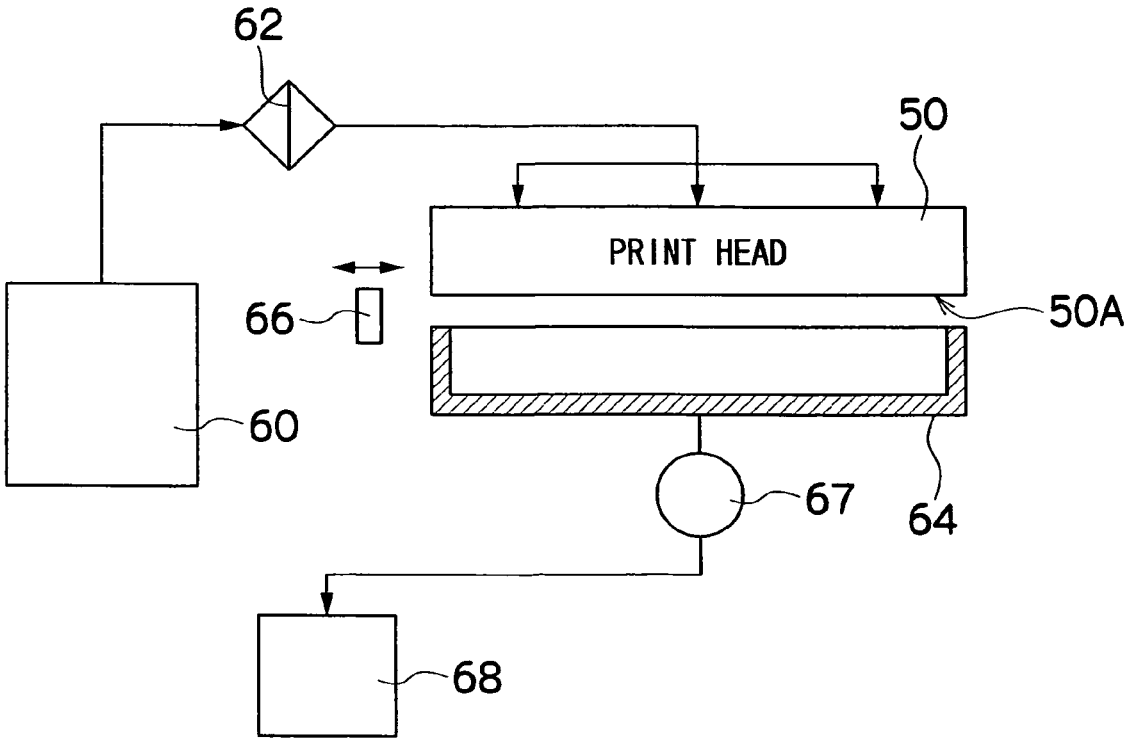
FIG. 7 is a schematic drawing showing a configuration of an ink supply system in the inkjet recording apparatus.

FIG. 7 is a schematic drawing showing the configuration of the ink supply system in the inkjet recording apparatus 10. The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 7 is equivalent to the ink storing and loading unit 14 in FIG. 1 described above.

A filter 62 for removing foreign matters and bubbles is disposed between the ink supply tank 60 and the print head 50 as shown in FIG. 7. The filter mesh size in the filter 62 is preferably equivalent to or less than the diameter of the nozzle and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink of which viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state the actuator 58 is operated (in a viscosity range that allows ejection by the operation of the actuator 58), and the preliminary ejection is made toward the ink receptor to which the ink of which viscosity has increased in the vicinity of the nozzle is to be ejected. After the nozzle surface is cleaned by a wiper such as the cleaning blade 66 provided as the cleaning device for the nozzle face, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the pressure chamber 52, ink can no longer be ejected from the nozzles even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink of which viscosity has increased is removed by suction.

However, this suction action is performed with respect to all the ink in the pressure chamber 52, so that the amount of ink consumption is considerable. Therefore, a preferred aspect is one in which a preliminary ejection is performed when the increase in the viscosity of the ink is small.

Description of Control System

Figure 8:
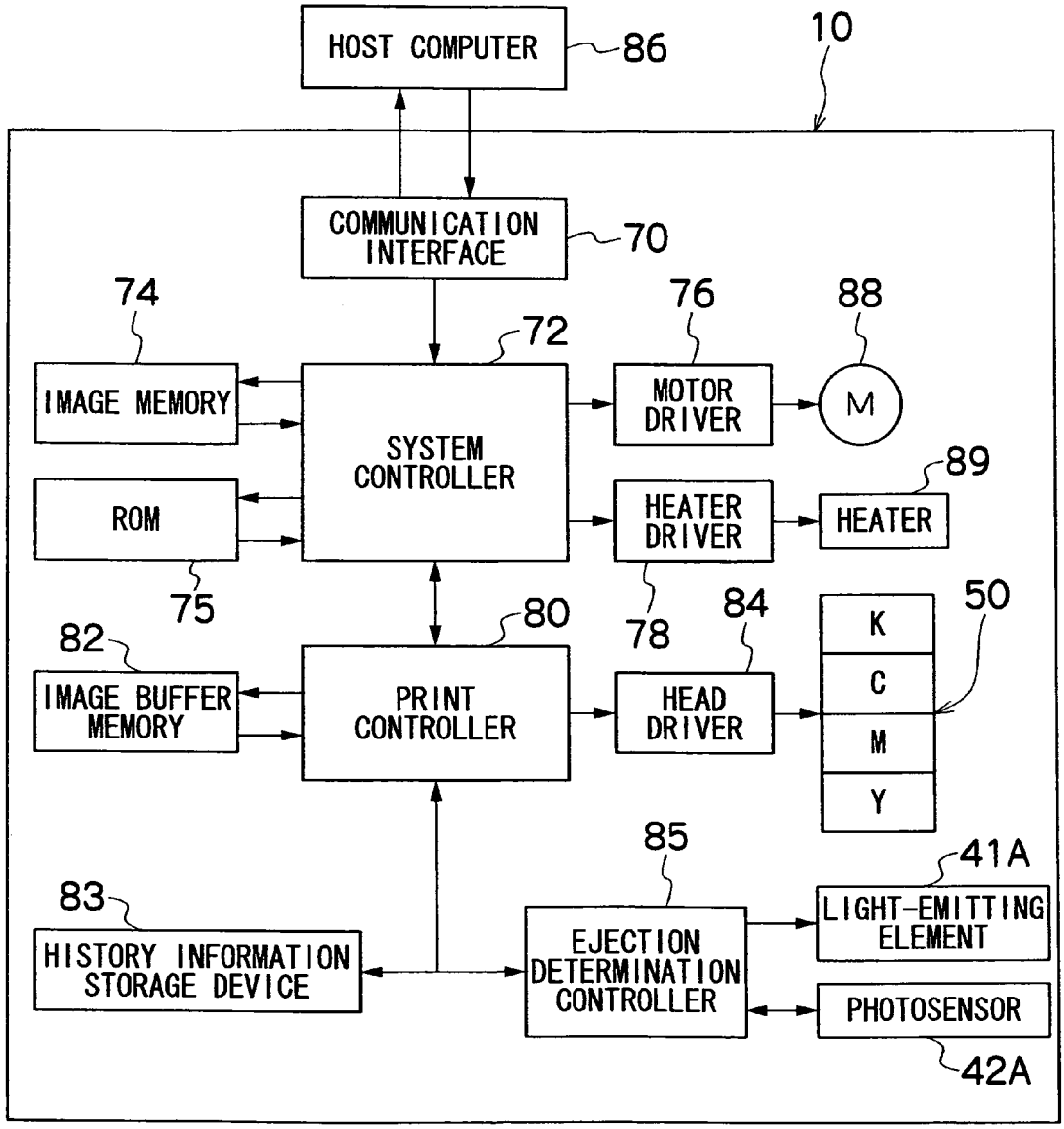
FIG. 8 is a principal block diagram showing the system composition of the inkjet recording apparatus.

FIG. 8 is a block diagram of the principal components showing the system configuration of the inkjet recording apparatus 10. The inkjet recording apparatus 10 has a communication interface 70, a system controller 72, an image memory 74, ROM 75, a motor driver 76, a heater driver 78, a print controller 80, an image buffer memory 82, a history information storing unit 83, a head driver 84, an ejection determination controller 85, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 functions as a control device for controlling the whole inkjet recording apparatus 10 in accordance with a prescribed program, and it also functions as a calculating device for performing various types of calculations. More specifically, the system controller 72 is constituted by a central processing unit (CPU), peripheral circuits relating to same, and the like. The system controller 72 controls respective units, such as the communications interface 70, image memory 74, ROM 75, motor driver 76, and the like, and it also controls communications with the host computer 86 and read and write operations to and from the image memory 74, ROM 75, and the like, as well as generating control signals for controlling the conveyance motor 88 and the heater 89.

The ROM 75 stores programs executed by the CPU of the system controller 72, various data required for control procedures, and the like. It is preferable that the ROM 75 is a non-rewriteable storage device, or a rewriteable storage device such as an EEPROM. The image memory 74 is used as a temporary storage region for image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the ejection amount and the ejection timing of the ink droplets from the respective print heads 50 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 (corresponding to the ejection drive device) for the print head 50 of each color on the basis of the print data received from the print controller 80. A feedback control system for keeping the drive conditions for the print heads constant may be included in the head driver 84.

The image data to be printed is externally inputted through the communication interface 70, and is stored in the image memory 74. In this stage, the RGB image data is stored in the image memory 74. The image data stored in the image memory 74 is sent to the print controller 80 through the system controller 72, and is converted to the dot data for each ink color by a known dithering algorithm, random dithering algorithm or another technique in the print controller 80.

According to the dot data (the image data) thus generated by the print controller 80, the print head 50 is driven so that ink-droplets are ejected from the print head 50. The image is formed on the recording paper 16 by controlling the ink-droplet ejection from the print head 50 in synchronization with the conveyance velocity of the recording paper 16.

The ejection determination controller 85 comprises: a light source control circuit for controlling switching on and off of the light-emitting elements 41A provided in the light source unit 41 and the quantity of light emitted when the element is switched on; a drive circuit for the photosensors 42A provided in the light receiving unit 42; and a signal processing circuit for processing the determination signals from the photosensors 42A. The ejection determination controller 85 controls the operations of the light-emitting elements 41A and the photosensors 42A in accordance with the commands from the print control unit 80, and gives the determination results obtained from the photosensors 42A to the print control unit 80.

The print control unit 80 judges whether or not the nozzles 51 have ejected, on the basis of the determination information obtained via the ejection determination controller 85, and if the print control unit 80 detects a nozzle that has not ejected, then it implements control for performing a prescribed restoring operation or for correcting droplet ejection, or the like.

The print controller 80 functions as a "drive control device", a "nozzle selecting device" and an "ejection state judging device", in conjunction with the system controller 72.

The history information storing unit 83 is a storage device for storing information relating to the inspection history and the ejection history, for each nozzle 51 in the print head 50. Hereafter, the information is referred to as "history information". Each time that a determination operation or an ejection operation is performed, the history information is updated. The nozzle 51 to be inspected is determined on the basis of that history information.

Next, a method for determining ejection in an inkjet recording apparatus 10 having the composition described above is explained.

First Determination Method

An ejection is performed from a particular individual nozzle under evaluation at an ejection timing that is set earlier or later than that of the other nozzle groups, within the range of the recording ejection cycle, and the ejection is determined.

Figure 9:
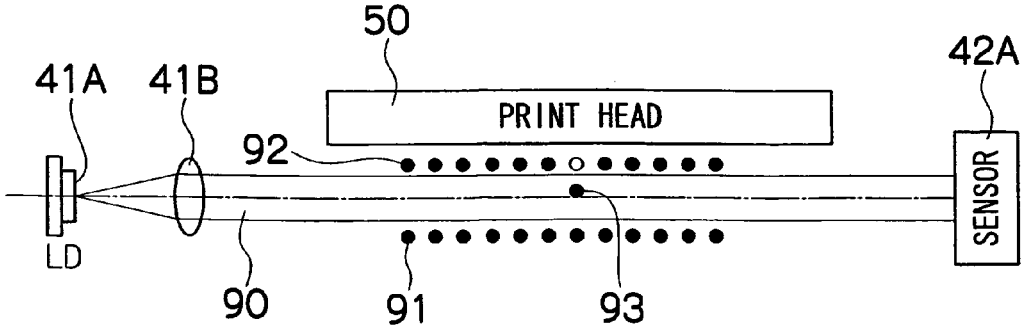
FIG. 9 is a schematic drawing of a state during ejection determination according to a first ejection determining method.

FIG. 9 is a schematic diagram showing a state of droplets ejected from the print head 50. The black circles in FIG. 9 indicate droplets ejected from the nozzles 51 of the print head 50. Also, the droplets 91 depicted in line below the determination beam 90 as shown in FIG. 9 indicate droplets that have been ejected from the nozzles 51 simultaneously at a certain timing $t_1$. Furthermore, the droplets 92 depicted in line above the determination beam 90 indicate droplets that have been ejected simultaneously at a timing of $t_2=t_1+T$, after the normal recording ejection cycle T.

The nozzle (not shown) corresponding to the position indicated by the white circle shown in FIG. 9 is the nozzle under evaluation, and the ejection timing is updated for this nozzle only when it is being evaluated. In other words, the nozzle under evaluation is driven to eject ink at timing before the normal recording ejection cycle T, in such a manner that only the droplet 93 ejected from the evaluated nozzle enters into the determination beam 90. Since the output signal (determination signal) from the photosensor 42A changes according to whether or not a droplet is present inside the determination beam 90, it is possible to judge whether or not ink has been ejected from the nozzle evaluated on the basis of the sensor output.

Figure 10A:
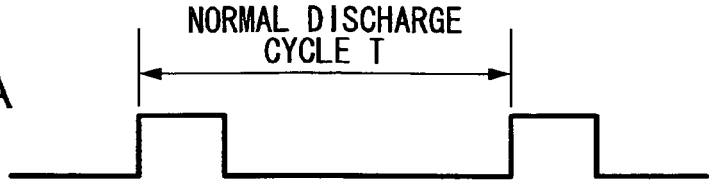
FIGS. 10A and 10B are timing chart diagrams of the ejection determining operation shown in FIG. 9.
Figure 10B:
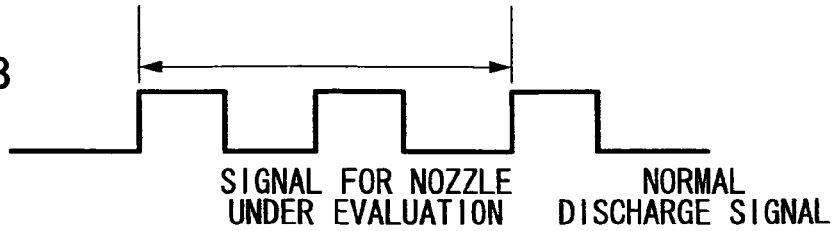

FIGS. 10A and 10B are timing chart diagrams showing the ejection timing. FIG. 10A shows the ejection signal in the case of a normal printing operation, and FIG. 10B shows the timing of the ejection signal in a case where ejection determination is performed for a nozzle under evaluation.

As shown in FIG. 10A, during a normal print operation where ejection determination is not performed, ejection is driven at a uniform recording ejection cycle T (normal recording ejection cycle). As described with respect to FIG. 9, the recording ejection cycle T is set to provide a time difference in such a manner that a droplet 92 relating to a subsequent ejection operation enters into the determination beam 90 after the droplet 91 ejected previously has passed completely through the determination beam 90.

As shown in FIG. 10B, if determining the ejection of nozzle under evaluation, the ejection timing for the nozzle under evaluation is moved to an earlier timing, within the range of the recording ejection cycle T, and an ejection signal is supplied to the evaluated nozzle at this ejection timing.

Figure 11:
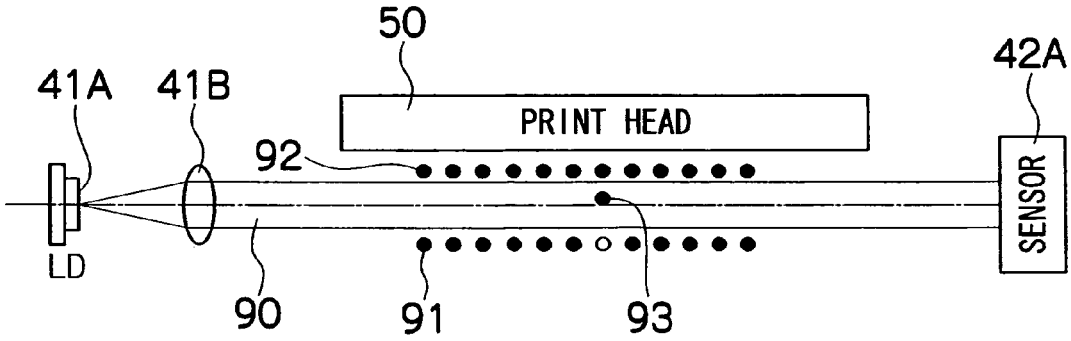
FIG. 11 is a schematic drawing of another state during ejection determination according to the first ejection determining method.

In addition, it is possible to adopt a mode to determine a droplet in flight from the nozzle under evaluation by causing the ejection timing of the nozzle under evaluation to be delayed after that of the other nozzles, as shown in FIG. 11.

Furthermore, the "amount of time" by which to stagger the ejection timing is calculated from the speed of the ejected droplets and the width of the detection light beam. For example, assuming that droplets are ejected at 10 kHz (recording ejection cycle T=0.1 msec) and an ejection speed of 5 m/sec in the case of normal ejection, then if the beam width (or height) is 0.2 mm, from $$\frac{0.2(\text{mm})}{5(\text{m/sec})} = 0.04(\text{msec}),$$

the amount of time by which the ejection can be staggered is 0.04-0.1 msec.

In this way, it is possible to inspect individual nozzles in a nozzle row by selectively changing the nozzle under evaluation.

Second Determination Method

Instead of the first determination method described above, it is also possible to adopt a second determination method as described below. More specifically, in this second determination method, when ejection is driven at a uniform recording ejection cycle T (normal recording ejection cycle) during a normal print operation where ejection determination is not performed, the ejection for determination and the determination to ejection are performed by multiplying the recording ejection cycle T by a factor of n (and the ejection frequency by $$\frac{1}{n}).$$

on condition that n is a positive number. Moreover, in synchronization with the recording ejection cycle, the conveyance speed of the recording medium is changed to the value obtained by multiplying the conveyance speed V during a normal print operation by $$\frac{1}{n}.$$

Figure 12:
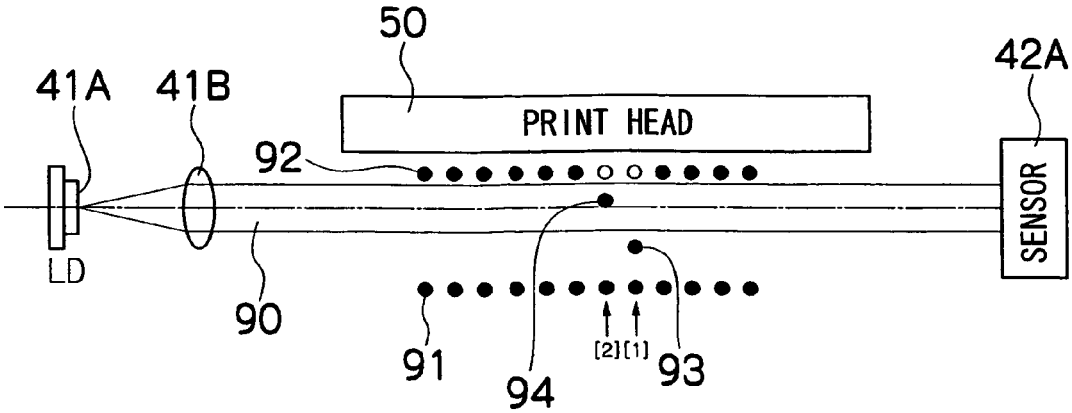
FIG. 12 is a schematic drawing of a state during ejection determination according to a second ejection determining method.

FIG. 12 is a schematic diagram showing a case where ejection determination is carried out by varying the recording ejection cycle, and FIGS. 13A to 13E are a timing chart diagrams relating to same.

FIG. 12 shows a state of the ejection determination performed respectively for two nozzles by staggering the ejection timings. The nozzle in the position indicated by (1) in FIG. 12 is called "nozzle under evaluation (1)" and the nozzle in the position indicated by (2) in FIG. 12 is called "nozzle under evaluation (2)".

Figures 13A, 13B, 13C, 13D, 13E:
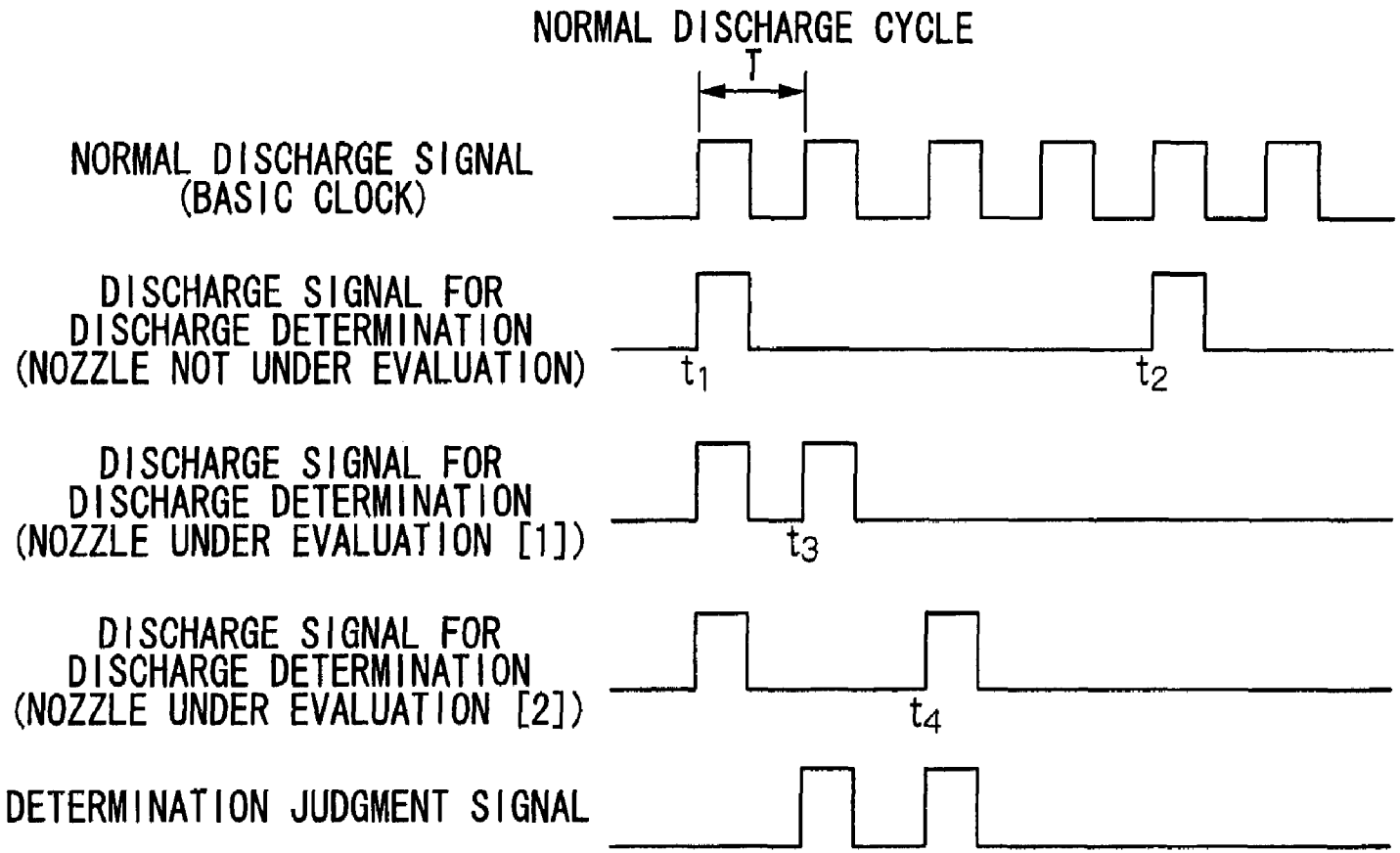
FIGS. 13A to 13E are timing chart diagrams of the ejection determining operation shown in FIG. 12.

FIG. 13A shows an ejection signal in the case of a normal print operation where ejection determination is not performed. When the ejection is not being determined, ejection is driven at a uniform recording ejection cycle T (normal recording ejection cycle), in accordance with this basic clock. FIG. 13B is an ejection signal during ejection determination, and shows the drive timing for a nozzle that is not under evaluation. In this ejection signal, the recording ejection cycle is multiplied by four times with respect to the basic clock cycle T in FIG. 13A. The droplet indicated by numeral 91 in FIG. 12 is ejected at the timing $t_1$ in FIG. 13B, and the droplet indicated by numeral 92 in FIG. 12 is ejected at the timing $t_2=t_1+4\times T$.

FIG. 13C is an ejection signal during ejection determination, and it shows the drive timing of a first nozzle that is being evaluated (the nozzle under evaluation (1) illustrated in FIG. 12). At timing $t_3$ in FIG. 13C, the droplet indicated by numeral 93 in FIG. 12 is ejected.

FIG. 13D is an ejection signal during ejection determination, and it shows the drive timing of a second nozzle that is being evaluated (the nozzle under evaluation (2) illustrated in FIG. 12). At timing $t_4$ in FIG. 13D, the droplet indicated by numeral 94 in FIG. 12 is ejected.

FIG. 13E shows a determination judgment signal for the nozzles under evaluation (1) and (2), whereby the output signal of the photosensor is read out in synchronism with the ejection timing from the nozzles under evaluation shown in FIGS. 13C and 13D.

In order that normal image formation can be achieved during ejection determination (i.e., image formation of equal quality to that when ejection is not being determined), the speed of conveyance of the recording paper 16 is also changed in conjunction with the change in the recording ejection cycle in FIGS. 13B to 13D.

The method of setting the parameter "n" for determining the recording ejection cycle for an ejection operation may be based on a mode where the suitable value is calculated automatically from the total number of nozzles to be evaluated. Additionally, the method of setting the parameter "n" may be also based on a mode where the user is able to set a value which achieves a suitable determination frequency. Furthermore, the method of setting the parameter "n" may be also based on a mode where a suitable value is calculated in accordance with a selection for switching productivity (high-speed, medium-speed, low-speed, or the like).

Relationship Between Change Parameter "n" for Recording Ejection Cycle and Determination Frequency Next, the relationship between the change parameter "n" for the recording ejection cycle and the determination frequency is explained. Here, a case in which all of the nozzles of the print head 50 are inspected is described.

In the case of n=1, the sub-scanning conveyance speed V maintains the value of V and no determination operation is carried out. Alternatively, the determination operation is carried out as described in "First determination method".

In the case of n=2, the sub-scanning conveyance speed is calculated from $$\frac{V}{2}.$$

During one imaging operation (for one page), ejection determination can be performed once (average frequency) for each nozzle that ejects onto an imaging range having a vertical-to-horizontal ratio of 1:1 corresponding to the number of imaging dots. If the paper is square paper having the same density of dots in the vertical and horizontal directions, then a determination frequency of one determination operation per nozzle per page is achieved.

In the case of n=3, the sub-scanning conveyance speed is calculated from $$\frac{V}{3}.$$

During one printing operation (for one sheet), ejection determination can be performed twice (average time) for each nozzle that ejects onto a printing range having a vertical-to-horizontal ratio of 1:1 corresponding to the number of printing dots. If the paper is square paper having the same density of dots in the vertical and horizontal directions, then a determination frequency of two determination operations per nozzle per page is achieved.

In other words, if n=k, then the sub-scanning conveyance speed is $$\frac{V}{k},$$

and ejections can be determined at "k−1" times per page, in the case of square paper. During ejection determination, the printing speed is $$\frac{1}{k-1}$$

times as the normal printing speed (when ejection is not being determined).

Example of Setting for "n" in Case of Fixed Determination Frequency (Where Nozzle to be Evaluated is Selected)

Next, a case where the determination frequency is fixed and the nozzle under evaluation is selected will be considered. For example, if a determination time of once is set for 1000 sub-scanning lines, then ejection will not be determined during a cycle of 999 lines. If a print head with high-density nozzles (2400 npi) is used, then this corresponds to a range of approximately 10 mm on the recording medium.

In the case of a 12-inch wide print head having a density of 2400 npi, the total number of nozzles is 288,000. Supposing that 1000 of these nozzles are to be evaluated, the sub-scanning conveyance speed is set to $$\frac{V}{2},$$

in accordance with formula (1);

$$n = \frac{1000\,(\text{nozzles})}{1000\,(\text{lines})} + 1 = 2. \tag{1}$$

Furthermore, if the number of nozzles to be evaluated is 5000, the sub-scanning conveyance speed is set to $$\frac{V}{6},$$

in accordance with formula (2);

$$n = \frac{5000\,(\text{nozzles})}{1000\,(\text{lines})} + 1 = 6. \quad (2)$$

Selection of Nozzles to be Evaluated

In a composition having a storage device for storing the history information for each nozzle 51 (a history information storage device 83), the particular nozzle that is to be inspected is determined as described below, for example.

The following types of nozzles are candidates for a nozzle that is to be inspected: nozzles where an ejection defect has been detected in a previous inspection; nozzles which have not performed an ejection operation for a predetermined period of time or more; and nozzles where the possibility of ejection abnormalities is inferred from the determination results of a separate determination system (for example, an ejection determination device (not illustrated) to read in print results by means of an image reading sensor such as CCD, for measuring the dot size and the dot landing position while determining the presence or absence of ejection).

Figure 14:
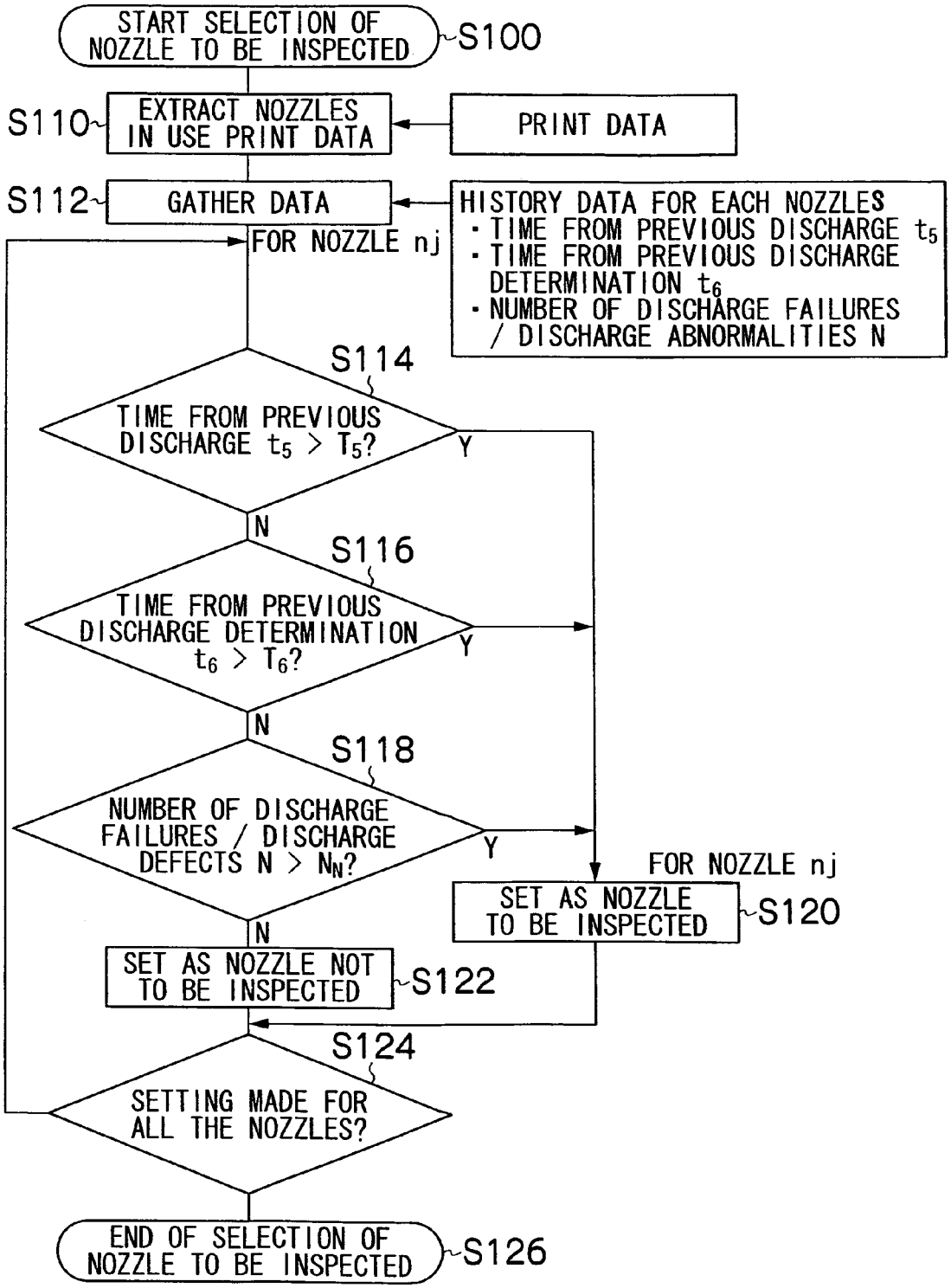
FIG. 14 is a flowchart showing an example of a control sequence in a process for selecting a nozzle to be inspected.
Figure 15:
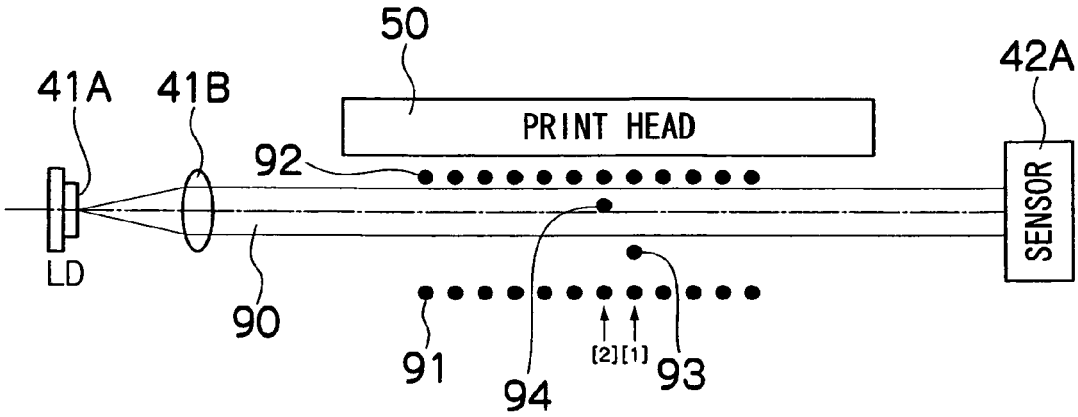
FIG. 15 is a schematic drawing of a state during ejection determination in a case where an ejection operation for ejection determination is performed at a staggered ejection timing, in addition to a normal printing ejection.
Figure 16A:
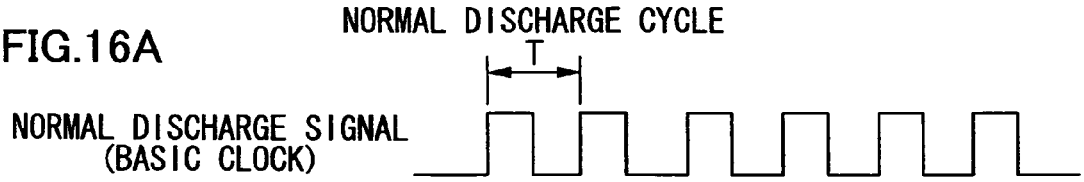
FIGS. 16A, to 16E are a timing chart diagrams of the ejection determining operation shown in FIG. 15.
Figure 16B:
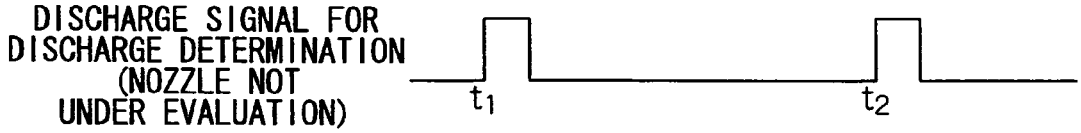
Figure 16C:
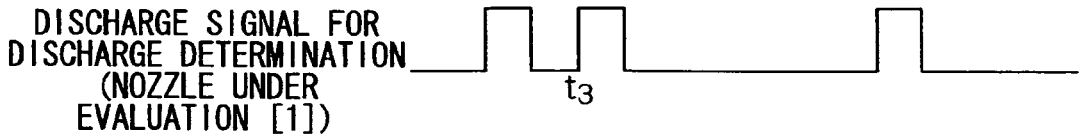
Figure 16D:
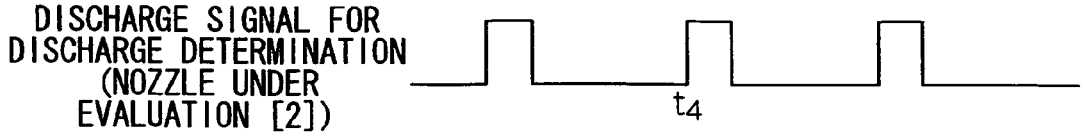
Figure 16E:
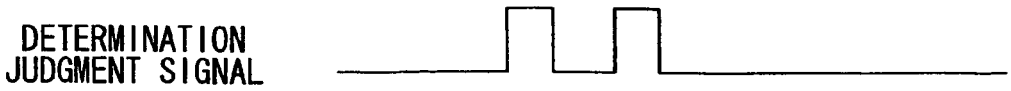

FIG. 14 is a flowchart showing an example of a control sequence for selecting a nozzle that is to be evaluated (nozzle under inspection).

As shown in FIG. 14, when the process for selecting the nozzle under inspection is started (step S100), the nozzles to be used in printing are extracted first (step S110). Next, necessary data is read out from the history data for each nozzle and is stored in the memory (step S112). According to the step S112, the read data is information such as the time from the previous ejection ($t_5$), the time from the previous ejection determination operation ($t_6$), the number of times (N) that an ejection failure or ejection abnormality has occurred, and the like. Next, the information is acquired for each nozzle and is compared with each judgement threshold values $T_5$, $T_6$, and $N_N$ (steps S114 to S118).

In other words, at the step S114, it is judged whether or not the time $t_5$ from the previous ejection exceeds a prescribed threshold value $T_5$ in relation to the number "j" nozzle nj. If the verdict of this judgement is "YES" (i.e., the relationship $t_5>T_5$ is satisfied), the sequence advances to the step S120, and the nozzle nj is established as a nozzle to be investigated.

On the other hand, if the verdict at the step S114 is "NO", the sequence advances to the step S116, and it is judged whether or not the time period $t_6$ from the previous ejection determination has exceeded the prescribed threshold value $T_6$. If the verdict in the judgement at step S116 is "YES" (i.e., the relationship $t_6>T_6$ is satisfied), the sequence advances to step S120 and the nozzle nj is established as a nozzle to be inspected.

Furthermore, if the verdict at the step S116 is "NO", the sequence advances to the step S118, and it is judged whether or not the number of ejection failures or ejection abnormalities N has exceeded a prescribed threshold value $N_N$. If the verdict in the judgement at the step S118 is "YES" (i.e., the relationship $N>N_N$ is satisfied), the sequence advances to the step S120, and the nozzle nj is established as a nozzle to be inspected.

If the verdict in the judgement at the step S118 is "NO", then the nozzle nj is established as a nozzle that is not to be inspected (step S122).

After the step S120 or S1 22, the sequence advances to the step S124, and it is judged whether or not a respective setting (nozzle to be inspected or nozzle not to be inspected) has been established for all of the nozzles. If the verdict in the judgement at the step S124 is "NO" (if there remain nozzles for which no setting has been established), the sequence returns to the step S114, and the aforementioned processing (the steps S114 to S122) is repeated for a nozzle that has not been established.

If it is confirmed in the judgement step at S124 that a setting has been established for all of the nozzles, the verdict of "YES" is obtained and the process of setting the nozzles to be inspected terminates (step S126).

Further Example of Ejection Control

In the first ejection determination method and the second ejection determination method described above, ejection is performed at a staggered ejection timing at the nozzles under evaluation (1) and (2), rather than at the normal ejection timing, but as shown in FIG. 15 and FIGS. 16A to 16E, it is also possible to adopt a mode in which an ejection operation for determination is performed at a staggered ejection timing at the nozzles under evaluation (1) and (2), in addition to normal ejection for printing. Hereinafter, in FIGS. 15 to 16E, the members which are common to those in FIGS. 12 to 13E are labeled with the same reference numerals, and description thereof is omitted here.

Modified Embodiment

Figure 17:
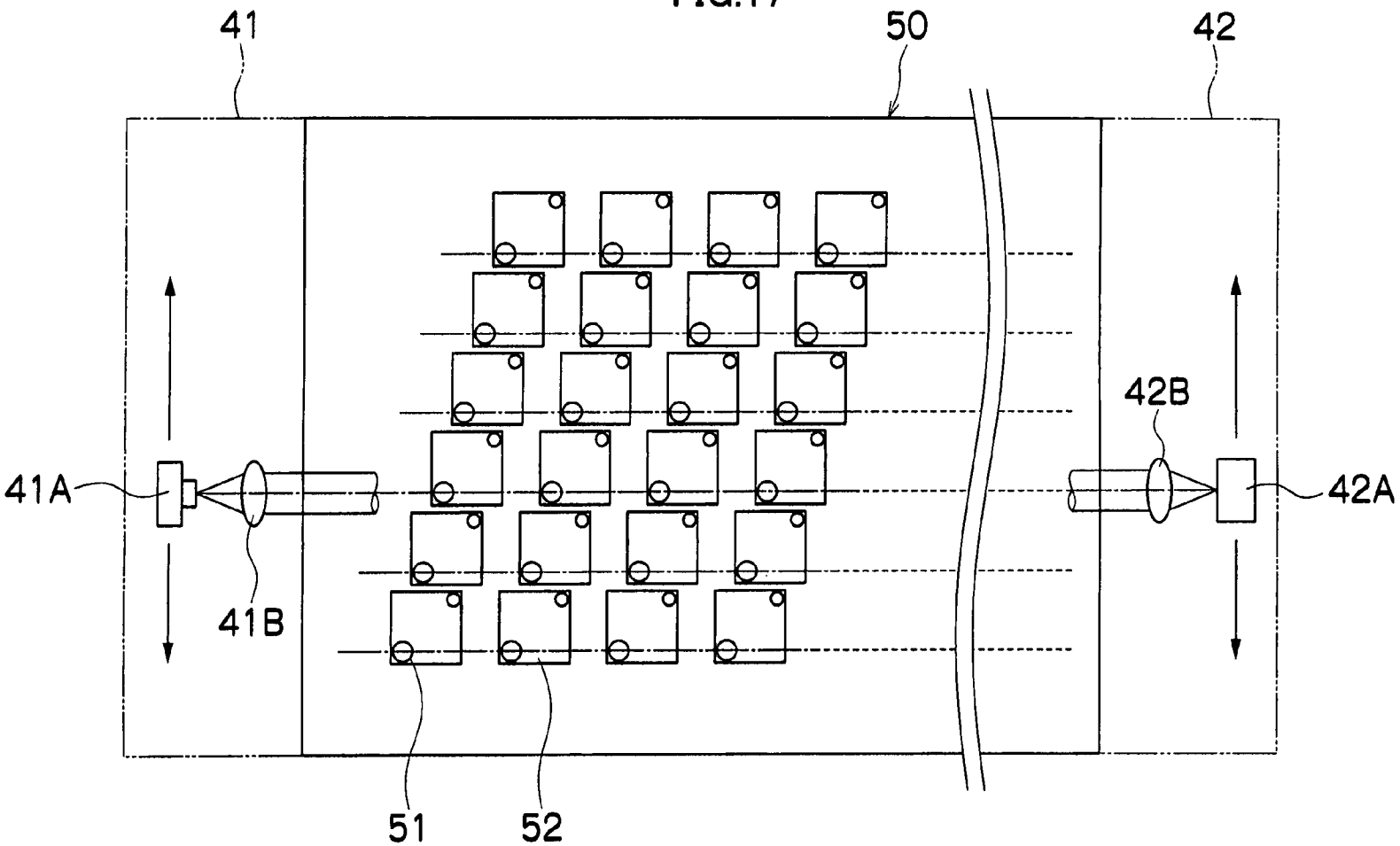
FIG. 17 is a schematic drawing of another configuration of an ejection determining optical system.

In FIG. 6, a plurality of light-emitting elements 41A and photosensors 42A are provided for each nozzle row aligned in the direction of extension (longitudinal direction) of the print head 50. However, instead of this composition, it is also possible to adopt a composition in which, a pair comprising a light-emitting element 41A and a photosensor 42A is configured so as to be movable in the shorter direction of the print head 50 by means of a movement mechanism (not illustrated), as shown in FIG. 17. Therefore, each nozzle row can be inspected by scanning the light-emitting element 41A and the photosensor 42B in accordance with the ejection timings of the nozzle rows.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which includes a plurality of nozzles to eject ink droplets;

an ejection drive device which drives ejection to eject the ink droplets from the nozzles of the ejection head onto a recording medium;

a conveyance device which moves the ejection head and the recording medium relatively to each other by conveying at least one of the ejection head and the recording medium;

a light-emitting device which generates determination light which intersects with flight paths of the ink droplets ejected from the nozzles;

a light receiving device which receives the determination light having passed through the flight paths and outputs a determination signal corresponding to quantity of the determination light received;

a drive control device which controls stagger of ejection timing of a nozzle subject to an ejection determination in accordance with ejection timings of other nozzles by controlling the ejection drive device on the basis of image data during a recording ejection operation for forming an image on the recording medium; and an ejection state judging device which judges ejection state of the ink droplets from the nozzle subject to the ejection determination, on the basis of the determination signal which is obtained from the light receiving device at a determination timing corresponding to the ejection timing of the nozzle subject to the ejection determination.

2. The image forming apparatus as defined in claim 1, wherein the drive control device makes the ejection timing of the nozzle subject to the ejection determination different than the ejection timings of the other nozzles, within range of a recording ejection cycle during a normal recording ejection operation in which no ejection determination is carried out.

3. The image forming apparatus as defined in claim 1, wherein the drive control device sets a recording ejection cycle of the other nozzles at a value obtained by multiplying a recording ejection cycle T during a normal recording ejection operation in which no ejection determination is carried out, by a positive number n, while setting a conveyance speed of the conveyance device at a value obtained by multiplying a conveyance speed V during the normal recording ejection operation by $$\frac{1}{n}$$

in synchronization with the recording ejection cycle obtained, so as to control the nozzle subject to the ejection determination for ejecting between respective ejection timings of the other nozzles on the basis of the recording ejection cycle obtained.

4. The image forming apparatus as defined in claim 1, further comprising:

a history information storage device which stores history information including at least one of history of the ejection determination and history of the ejection; and a nozzle selecting device which selects the nozzle to subject to the ejection determination on the basis of the history information.

5. The image forming apparatus of claim 1, wherein the nozzle subject to the ejection determination and the other nozzles are arranged in a same nozzle row perpendicular to a direction in which the recording medium is moved relatively to the ejection head.

6. An ejection determining method of an image forming apparatus which forms an image on a recording medium by ejecting ink droplets from nozzles of an ejection head formed with a plurality of nozzles which eject the ink droplets, while relatively moving the ejection head and the recording medium by conveying at least one of the ejection head and the recording medium, the ejection determining method comprising the steps of:

providing a light emitting device which emits determination light intersecting with flight paths of the ink droplets ejected from the nozzle, and a light receiving device which receives the determination light having passed through the flight paths and obtains a determination signal in accordance with quantity of the determination light received;

controlling ejection driving of the nozzles on the basis of image data, and stagger of an ejection timing of a nozzle subject to an ejection determination in accordance with ejection timings of the other nozzles during a recording ejection operation for forming the image on the recording medium; and judging ejection state of the ink droplets from the nozzle subject to the ejection determination on the basis of the determination signal obtained from the light receiving device at a determination timing corresponding to the controlled the ejection timing of the nozzle subject to the ejection determination.

* * * * *